United States Patent [19]

Ikegami et al.

[11] 3,971,519

[45] July 27, 1976

[54] MECHANISM FOR PREVENTING THE ADVERSE EFFECTS OF CENTRIFUGAL FORCE IN A STRAND WINDING MACHINE

[75] Inventors: Yoshio Ikegami; Hirohumi Kimura; Tadashi Kohge, all of Kobe; Katsuji Sakamoto; Takenbu Higashimoto, both of Yokohama, all of Japan

[73] Assignees: Kobe Steel Ltd., Kobe; Sumitomo Electric Industries, Ltd., Osaka, both of Japan

[22] Filed: Oct. 15, 1974

[21] Appl. No.: 514,848

[30] Foreign Application Priority Data

Oct. 13, 1973 Japan ..... 48-118923

[52] U.S. Cl. ..... 242/25 A

[51] Int. Cl.[2] ..... B65H 67/04

[58] Field of Search ..... 242/25 A, 18 A, 18 PW, 242/25 R

[56] References Cited

UNITED STATES PATENTS 2,961,175 11/1960 Detrick et al. ..... 242/25 A 3,831,871 8/1974 Ikegami et al. ..... 242/25 A

*Primary Examiner*—Stanley N. Gilreath

*Attorney, Agent, or Firm*—Oblon, Fisher, Spivak, McClelland & Maier

[57] ABSTRACT

A device for ensuring the smooth shifting of a strand from a full reel to an empty reel in a strand winding machine including improvements in the snaggers provided on the wheels which are rotating with the two associated reels arranged parallel to each other. The snaggers are provided on each wheel and are supported by a shaft parallel to the central axis of revolution of the wheel such that the snaggers are rotatable about the shaft. The centroids of the snaggers are displaced from the pivot of the snagger itself, that is, positioned on that side of the pivot which is opposite from the pointed end of the snagger. Thus, the snagger can securely grip and hold the strand during rotation of the wheel and can release the strand when the wheel comes to rest.

3 Claims, 8 Drawing Figures

MECHANISM FOR PREVENTING THE ADVERSE EFFECTS OF CENTRIFUGAL FORCE IN A STRAND WINDING MACHINE

BACKGROUND OF THE INVENTION

1. Field of the Invention

The present invention relates generally to a device for ensuring the smooth shifting of a strand from a full reel to an empty reel in a strand winding machine and more particularly to improvements in the snaggers provided on the wheels which are rotating with the two associated reels arranged parallel to each other.

2. Description of the Prior Art:

In order to shift a strand from a full reel to an empty reel in a winding machine, it is generally practiced to provide snaggers, designed to catch and grip the strand, at the periphery of each wheel rotating with its corresponding reel. There is also a mechanism known such that when the wheel is rotation, the snaggers thereon are actuated to grip the strand by utilizing centrifugal force created by rotation of the wheel, and this gripping of the strand by the snaggers is released when the wheel comes to rest. For instance, British Pat. No. 966,955 shows a device in which pivotally movable members are provided radially on a wheel, with a tooth being formed at the end of each movable member such as to form a slot between each tooth and the wheel, the slot being varied in size in accordance with the movement of each pivoted member so as to automatically grip or release the strand.

Also known in the art is a mechanism in which mounting or dismounting procedure of the reel to or from the associated wheel maintains the strand gripping situation of the snaggers during the time when the reel is kept secured to the wheel, but such gripping of the snaggers on the strand is released when the reel is removed from the wheel. For instance, U.S. Pat. No. 3,695,528 discloses a snagger mechanism such that, when the reel is mounted in position on the associated wheel, each elastic member on the wheel is pressed by the axial movement of the reel to diminish the space between each snagger and the wheel to thereby grip the strand. According to this mechanism, gripping of the strand and release thereof are automatically accomplished in accordance with the mounting and dismounting of the reel relative to the associated wheel.

In any of these known mechanisms, however, it is difficult to effect automatic gripping and release under all circumstances. It is practically impossible to use such mechanisms for high speed operations where the take-up speed exceeds 3,000 m/min. For instance, the device shown in British Pat. No. 966,955 can be adapted only in a take-up mechanism where a pair of reels are arranged on the same axis in side by side relation. It cannot be used where two reels designed to be rotatable at high speeds are arranged axially parallel to each other. Also, the radial arrangement of the pivotally movable members involves a danger since an excessively high centrifugal force could be produced at high rotation speeds. On the other hand, U.S. Pat. No. 3,695,528 discloses a structure in which the centrifugal force affecting the movable parts is all sustained by the fixed members, so there is a possibility that in this mechanism the engagement of the snaggers may be weakened by the centrifugal force, and there is also difficulty involved with respect to increasing the strand gripping force. It is therefore extremely difficult if not impossible, with such a mechanism, to effect successful shifting of the strand at high speeds.

SUMMARY OF THE INVENTION

It is therefore an object of the present invention to provide a mechanism for accomplishing automatic gripping of the strand and release thereof by utilizing centrifugal force in a positive manner.

Another object of the invention is to realize the full utilization of the effects due to centrifugal force and the movements incidental to mounting and dismounting the reel to accomplish automatic gripping and release.

Still another object is to provide a mechanism which will allow the strand to be gripped with a greater force when the snaggers are being acted upon by centrifugal force than when the wheel is stationary.

The present invention relates to a mechanism for preventing any adverse effects due to centrifugal force in a strand winding machine whereby the defects of conventional devices can be eliminated and whereby positive catching and gripping of the strand can be accomplished by snaggers even when the strand takeup speed is high, and such gripping of the strand by the snaggers is automatically released when the reel comes to rest or is removed. According to the present invention, automatic gripping by the snaggers and release thereof can be effected by utilizing both the centrifugal force and the movements incidental to mounting and dismounting of the reel, and the utilization of both techniques can be achieved with high reliability.

The mechanism according to the present invention comprises essentially wheels, each of which has its outer peripheral portion so shaped as to form a part of a cone, a shaft extending through the outer peripheral portions of the wheels and parallel to the center axis or revolution of each wheel, and snaggers provided rotatably on each outer peripheral portion at the shaft end, each of the snaggers being such that the centroid thereof is displaced from the pivot of the snagger such that the centroid is positioned on the opposite side of the pivot which is remote from the point end of the snagger. In order to ensure the positive and sure operation of the assembly, there is also provided a mechanism which allows the sliding movement of the shaft in the direction of the center axis of revolution synchronously with the mounting and dismounting of the reel. According to the present invention, owing to the above-combined mechanisms, each snagger is turned slightly when acted upon by centrifugal force and its end approaches the outer peripheral portion of the associated wheel to surely and securely catch and grip the strand.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
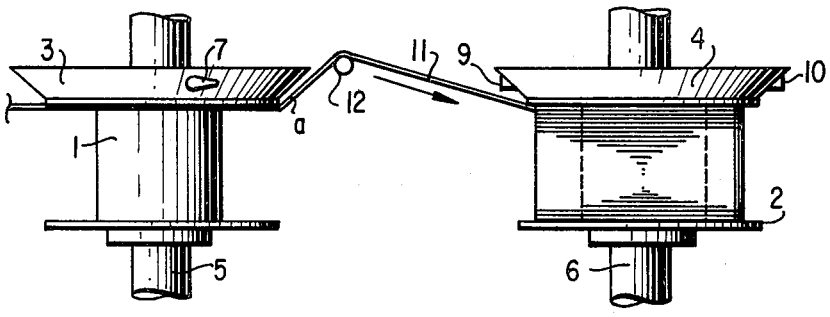
FIG. 1 is a plan view showing the essential parts of a winding machine in which the mechanism according to the present invention is adapted.
Figure 2:
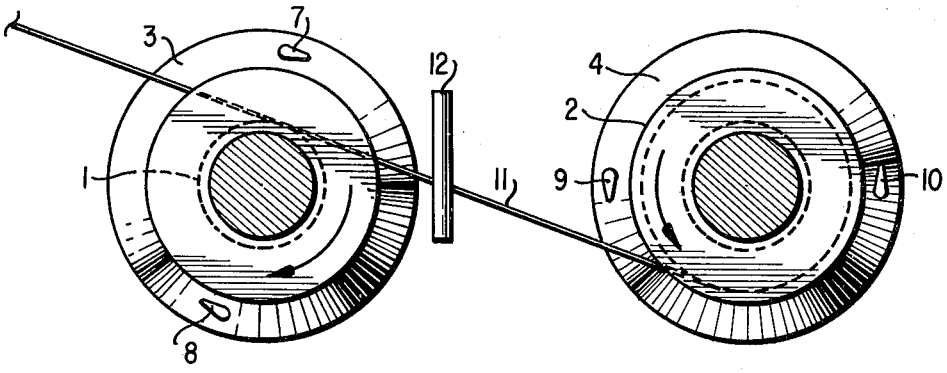
FIG. 2 is a side view of the winding machine shown in FIG. 1.
Figure 3:
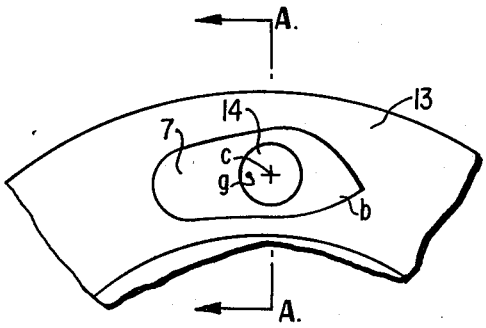
FIG. 3 is a partial enlarged view of a wheel incorporated with the mechanism according to the present invention.
Figure 4:
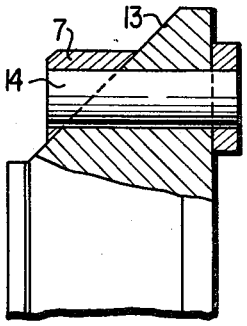
FIG. 4 is a partial sectional view taken along the line A—A of FIG. 3.

The mechanism for preventing the adverse effects of centrifugal force, according to the present invention, is adapted in a strand winding machine such as shown diagrammatically in FIGS. 1 and 2. A pair of reels 1 and 2 are arranged such that the axes of revolution thereof are parallel to each other. Reels 1 and 2 are rotatably supported by wheels 3 and 4, and driving shafts 5 and 6 are adapted to transmit the driving force to the respective wheels in order to rotate them. At the outer peripheral parts of wheels 3 and 4 are provided snaggers 7, 8, 9 and 10. When shifting a strand 11 from a full reel 2 to an empty reel 1, a shifter lever 12 is operated to allow the strand 11 to pass over the side walls of the reels 1 and 2, as shown in FIG. 1. The snaggers 7 and 8, on the wheel 3 are arranged to catch the portion a of the strand 11 to cut the strand portion positioned between the full reel 2 and the snagger 7 or 8 as soon as the strand 11 begins to be wound on the empty reel 1. Various improvements in this type of winding machine are known. The present invention concerns an improvement in the mechanism related to the snaggers 7, 8, 9 and 10 in a winding machine, and hence the winding machine itself is merely described in relation to the mechanism.

FIGS. 3 to 6 show an embodiment of the mechanism for preventing the adverse effects of centrifugal force according to the present invention. It will be seen that a snagger 7 is provided at an outer peripheral portion 13 of a wheel 3, the portion 13 being shaped in the form of a truncated cone. Snagger 7 and the outer peripheral portion 13 are pivotally joined by a shaft 14 which extends through the outer peripheral portion 13 such that the central axis of the shaft is parallel to the axis of revolution of the wheel 3. The snagger 7 is thus connected to the outer peripheral portion 13 through the shaft 14 such that it can turn slightly about the central axis of the shaft 14. In effectuating this turn of the snagger, the shaft 14 may be distorted or a slight displacement may be effected between the shaft 14 and the snagger 7 or between the shaft 14 and the outer peripheral portion 13. It is also to be noted that the centroid *g* of the snagger 7 is displaced from the pivot point *c* of the snagger 7, that is, it is positioned on the side of pivot *c* which is opposite the pointed end *b* of the snagger 7.

Figure 5:
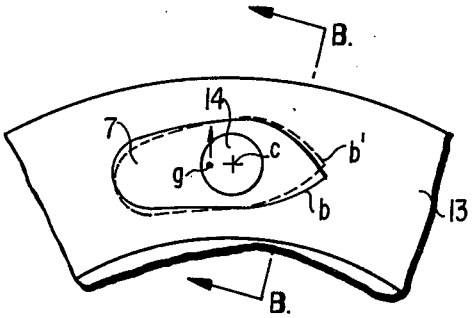
FIG. 5 is a view similar to FIG. 3 but showing the behavoir of a snagger.
Figure 6:
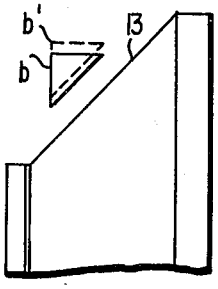
FIG. 6 is a partial sectional view taken along the line B—B of FIG. 5.

FIGS. 5 and 6 show the behavior of the wheel 3. The snagger 7 shown by solid line is in the position that it assumes when the wheel 3 is rotating, and the broken line shows the position of the snagger when the wheel 3 is stationary. When the wheel 3 rotates, centrifugal force affects all the parts which are in motion, but the resultant force of the centrifugal force affecting the snagger 7 acts on the centroid *g* of the snagger 7 in the radial direction such as to move it away from the central axis of revolution of the wheel 3, with the result that the snagger 7 is forced to turn slightly about the pivot *c* of the shaft 13. The pointed end portion *b* of the snagger 7 moves toward the central axis of revolution of the wheel 3. That is, the end portion of the snagger moves from the position *b'* to the position *b* to approach the outer peripheral portion 13 of the wheel 3, thereby increasing the pressure between the base area of the end portion *b* of the snagger 7 and the outer peripheral portion 13 of the wheel 3. Thus, when the wheel 3 rotates, the end portion *b* of the snagger 7 strongly grips the strand such that the strand holding force is not weakened, and when the wheel comes to rest, such gripping of the snagger 7 on the strand is released to enlarge the space between the end portion *b* and the outer peripheral portion 13. As noted from the foregoing, when the snagger 7 is exposed to the centrifugal force, it does not suffer the ill effects thereof, but rather the centrifugal force is utilized to effect the automatic gripping of the strand and release thereof. Furthermore, since the turning motion of the snagger 7 is effected on the shaft 14 parallel to the central axis of revolution of the wheel 3, dangers that could result from exposure to excess centrifugal force are minimized. Also, the assembly operates with certainty and can be used in combination with the mechanism to ensure a smooth and positive gripping and releasing behavior.

Figure 7:
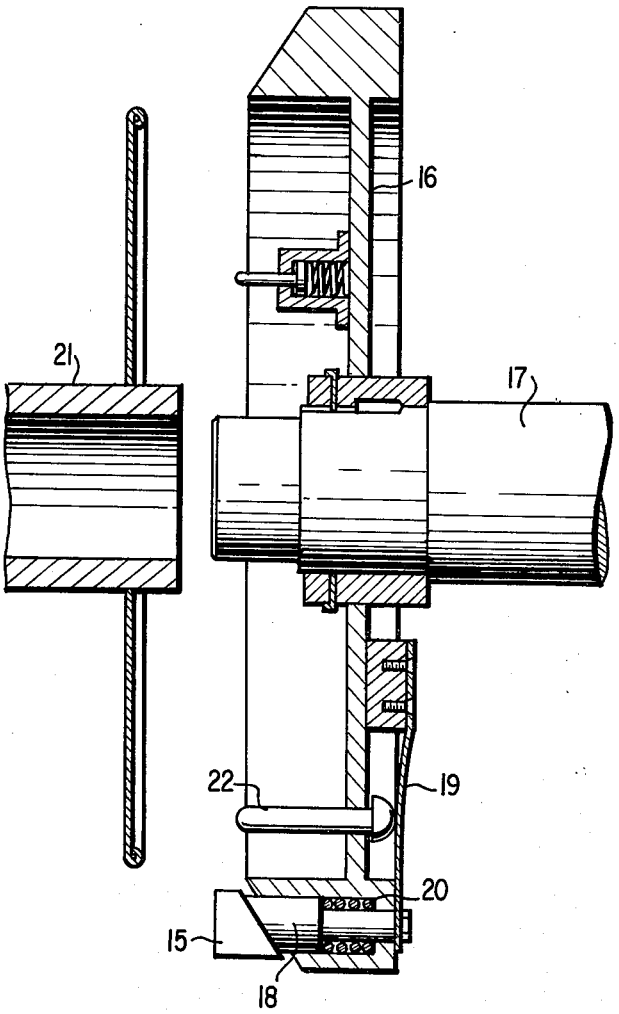
FIGS. 7 and 8 are sectional views of a wheel incorporated with the mechanism according to another embodiment of the present invention.
Figure 8:
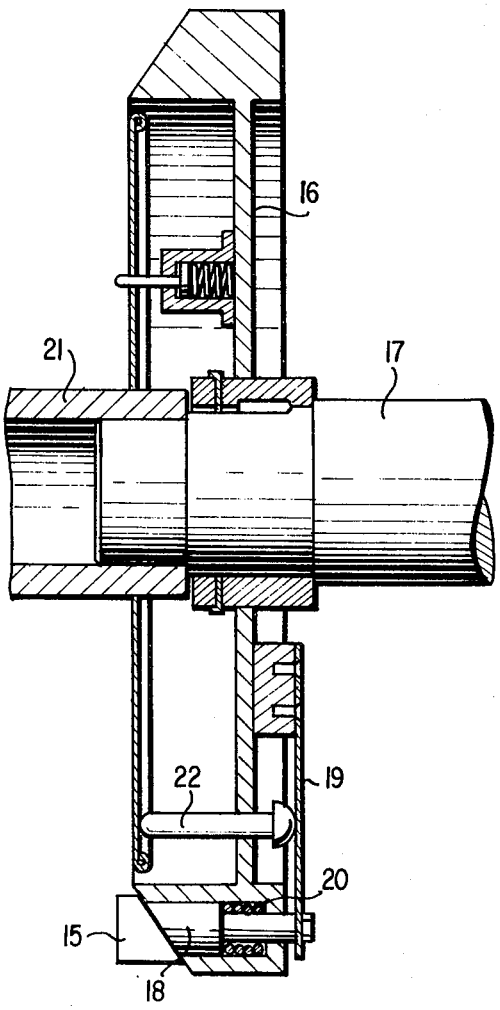

Referring now to FIGS. 7 and 8, there is shown another embodiment of the present invention where a mechanism for further ensuring secure gripping and releasing operations is added to the mechanism described and shown in FIGS. 3 to 6.

Snaggers 15 are provided at the frusto-conical outer peripheral portion of each wheel 16 and are secured to a shaft 18 extending through the wheel 16 parallel to the driving shaft 17. The shaft 18 is able to slide axially and turn slightly about its axis. As in the foregoing embodiment, each snagger 15 is so formed that its centroid is positioned at a point which is displaced from the central axis of revolution of the shaft 18 toward the side opposite the pointed end of the snagger. The shaft 18 is connected to a leaf spring 19 secured to each wheel 16, and a coil spring 20 is disposed between the shaft and each wheel 16. The leaf spring 19 is cantilevered from wheel 16 such that the tip portion thereof moves substantially in the axial direction of the wheel 16 in accordance with the axial movement of the shaft 18. The coil spring 20 produces a force which pushes snagger 15 into its open position. A pin 22 adapted to allow the leaf spring 19 to swing is provided projecting from the position corresponding to that portion of the wheel 16 upon which the reel is mounted.

FIG. 7 shows the state where the reel 21 is removed from the wheel 16 or where the reel 21 is about to be mounted on the wheel 16, and FIG. 8 shows the state where the reel 21 is mounted on the wheel 16. The reel 21 can rotate in this state.

When the reel 21 is mounted on the wheel 16, the side wall of the reel 21 pushes the pin 22 to allow the leaf spring 19 to swing, causing the shaft 18 to slide axially thereof. Consequently, the snagger 15 approaches the outer peripheral portion of the wheel 16 to catch and hold the strand. As the wheel 16 turns, the snagger 15 receives the action described in connection with FIG. 5 to grip the strand more strongly and securely. Since all the parts except for the leaf spring 19 are provided parallel to the central axis of revolution, they remain safe against any high centrifugal force that may be applied thereto. The leaf spring 19 is also useful as an axially swingable member under such a situation. When the strand fills reel 21 and the winding is switched to another empty reel, the reel rotation is stopped. At this moment, the snagger 15 is released from its forced rotation about the shaft 18 under centrifugal force to free the strand. Even if the strand should fail to be freed at this time, the strand can be removed positively from the snagger 15 as the shaft 18 slides to allow the snagger 15 to separate further away from the outer peripheral portion when the reel 21 is removed from the wheel 16.

As described above, the mechanism according to the present invention can be used in combination with a mechanism for bringing the snagger into the gripping or releasing position by the reel mounting and dismounting operation. Conventional devices of the type utilizing centrifugal force were unable to utilize the movement caused by mounting or dismounting the reel, while those of the type which did utilize movement were incapable of utilizing centrifugal force. The operation of the latter type was rather retarded by the centrifugal force. The present invention has made it possible to combine the advantages of both types while perfectly eliminating any adverse effects due to centrifugal force. Therefore, the winding machine adapted with the mechanism of the present invention is capable of effecting smooth and secure shifting of the strand as well as switching of the winding from a full reel to an empty one, and no reduction in productivity is realized even when the strand take-up speed is increased. Furthermore, since the strand can be separated surely and automatically from the wheel when removing the full reel from the winding machine, the present invention is greatly conducive to automation for the production of articles.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters Patent of the United States is:

1. In a strand winding machine having two wheels and two reels respectively supported thereon, snaggers provided at the outer peripheral portion of each wheel rotatable with said reels and a mechanism for shifting the strand from a full reel to an empty reel, the improvement comprising:

each of said wheels having the outer peripheral portion thereof shaped so as to form a part of a cone;

shafts extending through the outer peripheral portion of each of said wheels so as to be parallel to the central axis of revolution of each of said wheels;

a respective one of said snaggers provided at one end of each of said shafts so as to be pivotable on the outer peripheral portion of its associated wheel, each of said snaggers being so constructed as to include a pointed end for performance of a snagging operation and wherein the centroid of each snagger is positioned at a point displaced from the pivot of the respective snagger toward the side opposite the pointed end of said snagger;

a plurality of pins, each of which is provided at at radial position corresponding to a radial portion of each of said reels mounted upon each of said wheels; and pivotable members having a portion thereof pivotable along the axial direction of said wheels, each of said members being joined at one end thereof to a respective shaft and extending in a radial direction, beyond said position of each of said pins, so as to be pivoted in accordance with the movement of said corresponding pin, said other end of said member being secured to said wheel.

2. The mechanism as set forth in claim 1, wherein said shafts are axially slidable.

3. The mechanism as set forth in claim 1, wherein said pivotable members are leaf springs.

* * * * *